US005626302A

United States Patent [19]

Hrobar

[11] Patent Number: 5,626,302

[45] Date of Patent: May 6, 1997

[54] SEWING MACHINE CONE SPOOL TO SPINDLE ADAPTER

[76] Inventor: Nancy H. Hrobar, Rte. 2, Box 133, Ben Wheeler, Tex. 75754

[21] Appl. No.: 519,970

[22] Filed: Aug. 28, 1995

[51] Int. Cl.[6] ..... B65H 49/06

[52] U.S. Cl. ..... 242/130; 242/130.4; 242/597.7

[58] Field of Search ..... 242/130.4, 130.1, 242/129, 597.5, 597.7, 129.7, 130, 130.3, 139, 134, 571.4; 223/106; 112/1

[56] References Cited

U.S. PATENT DOCUMENTS

| | | | |
|---|---|---|---|
| 1,368,820 | 2/1921 | Menzl | 242/130 X |
| 1,497,675 | 6/1924 | Dover | 242/129.7 |
| 1,934,169 | 11/1933 | Crooks | 242/130 X |
| 2,915,260 | 12/1959 | Parrott | 242/130 |
| 3,055,609 | 9/1962 | Courtney | 242/130.1 |
| 3,413,826 | 12/1968 | Abowitz | 242/130 X |
| 3,738,590 | 6/1973 | Granati | 242/130 |

*Primary Examiner*—Michael R. Mansen
*Attorney, Agent, or Firm*—C. W. Alworth

[57] ABSTRACT

An adapter device to allow the use of industrial sized serger thread, woolly nylon or similar cone spools on consumer sewing machines. The adapter fits over the back spindle of a consumer sewing machine and permits the industrial sized cone spool to fit over the adapter and to pass the cone spool thread along the standard sewing machine thread path. The device has two embodiments, one for smaller cones and another for larger cones and together will accommodate cone thread spools containing up to 6,000 yards depending on the type of thread.

2 Claims, 9 Drawing Sheets

SEWING MACHINE CONE SPOOL TO SPINDLE ADAPTER

TECHNICAL FIELD OF THE INVENTION

This invention relates to the sewing machine industry and more specifically to an adapter for the home sewing machine so that the user can utilize specialty thread which is only available on cone spools.

BACKGROUND OF THE INVENTION

The modern home sewing machine is designed to be used with consumer thread spools having an outer diameter from one-half inch up to one and one-half inches with an inner aperture having a diameter of about 5 millimeters. The length of the consumer spool varies from about one-half inches to two inches. Thus, the consumer thread spool cannot contain a large quantity of thread. The limited quantity of thread causes few problems in average sewing; however, when one needs to run a long seam, such as in a quilt, the limited quantity of thread will cause problems.

The industrial spool, naturally, contains a larger quantity of thread; however, the industrial spool is larger and will not fit over the standard thread spool spindle found on a consumer sewing machine. In fact, the industrial spool takes on the shape of a truncated cone which is open at both ends: the industrial spool is known as the Cone Thread Spool. Naturally the top diameter is smaller than the bottom diameter with the top diameter within the range of about 1.8 cm to about 2.5 cm and the corresponding bottom diameter in the range of about 2.0 cm to about 4.0 cm. The actual sizes depend on the quantity and type of thread found on the cone spool. Furthermore, certain specialty threads are available only on industrial spools. It is, therefore, an advantage for the consumer to be able to use the smaller sized industrial spools of thread which have now found their way into the consumer market place.

PRIOR ART

Consumers, themselves, have resolved the problem of using thread that comes on cone spools. They simply stand the cone spool on its bottom (wider end) on the sewing table, next to the sewing machine. The thread is taken up to the top of the machine and into the normal thread path followed by the consumer spool thread. This approach works well for a cone spool with a large diameter base, for it will stand on its own. This method will not work with narrow base cone spools.

Standing the cone spool next to the sewing machine leads to a further problem in that the thread, feeding from the spool, will become entangled and jamb. One manufacturer has partially solved this problem by providing a cone stand with a guide wire over which the thread passes on its way to the sewing machine.

There is one further drawback with the above techniques. It is very easy to knock over a cone spool, or stand, while sewing. This creates a severe problem for the thread will almost immediately cease feeding and the thread will break or, worse, the machine will jamb.

Thus, there remains a need to provide the consumer with a device which allows for the use of industrial cone spool on a consumer sewing machine. The consumer requires a device that cannot be knocked over during operation and a device which will properly feed the thread into and along a standard sewing machine thread path.

SUMMARY OF THE INVENTION

The invention consists of two embodiments (due to varying sizes of industrial cones) which adapt the standard sewing machine thread spindle to fit a cone spool. The device is generally made of plastic, although any reasonable material could be used, having an inner diameter which is adapted to slidingly fit over the sewing machine spool spindle and having an outer diameter which matches the top and bottom inner diameters of the cone spool.

The correctly sized adapter is placed over the spool spindle of a sewing machine and the cone spool containing thread placed over the adapter. The thread from the cone spool is passed along the normal thread path followed by a standard consumer spool thread. Positioning the cone spool above the work table and on the sewing machine keeps the cone spool out of the user's way and allows the thread to spool off of the cone spool without tangling. Either of the two embodiments of the instant invention eliminates the disadvantages of the prior art.

DESCRIPTION OF THE PREFERRED EMBODIMENT

Figure 1A:
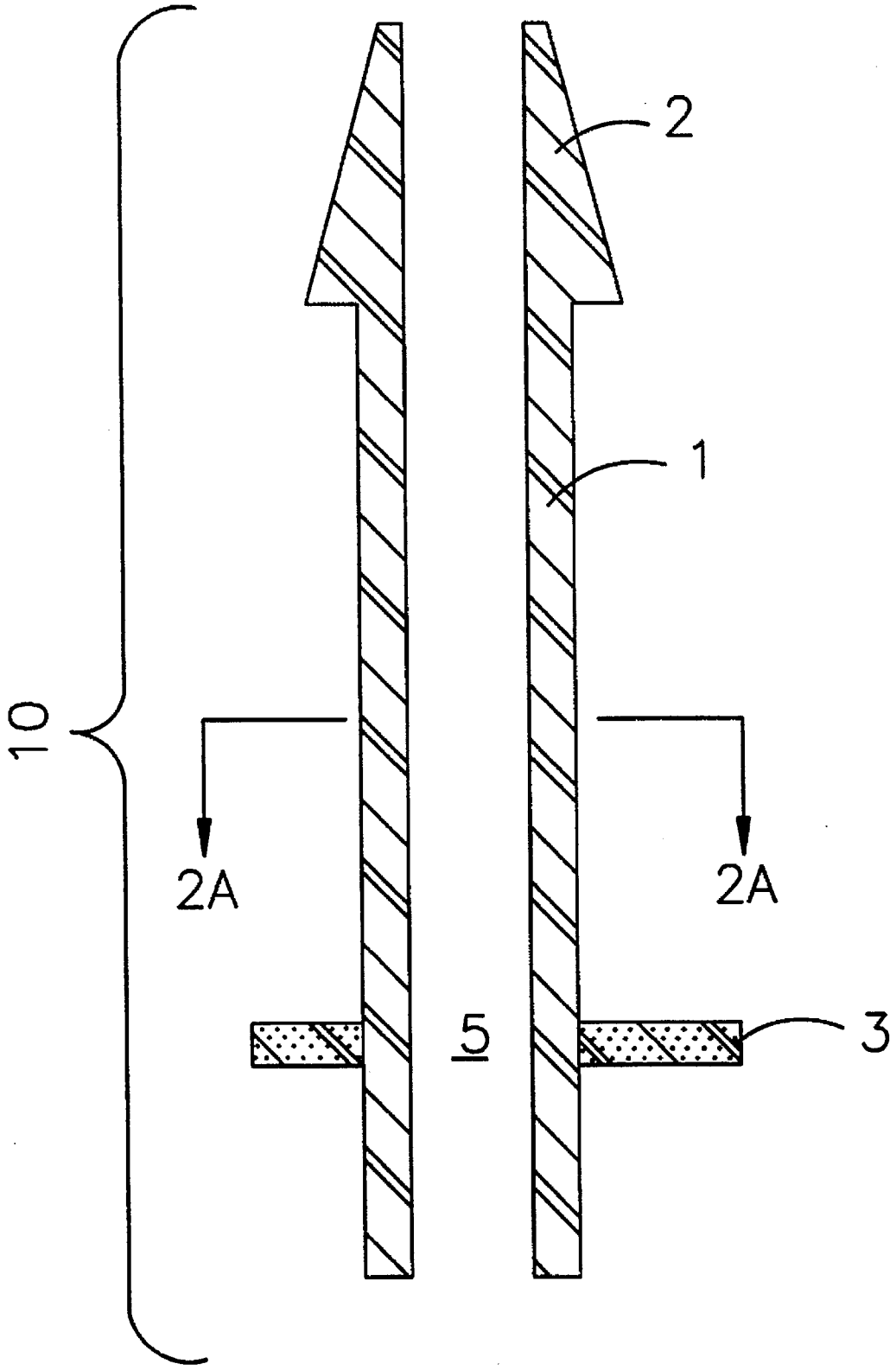
FIG. 1A is a cross-sectional view of the first embodiment of the instant invention, showing the conical top (upper taper cone) which matches the inside top diameter of a cone spool and showing the foam rubber, triangular, bottom lip which deforms to match the inside bottom diameter of the cone spool.
Figure 1B:
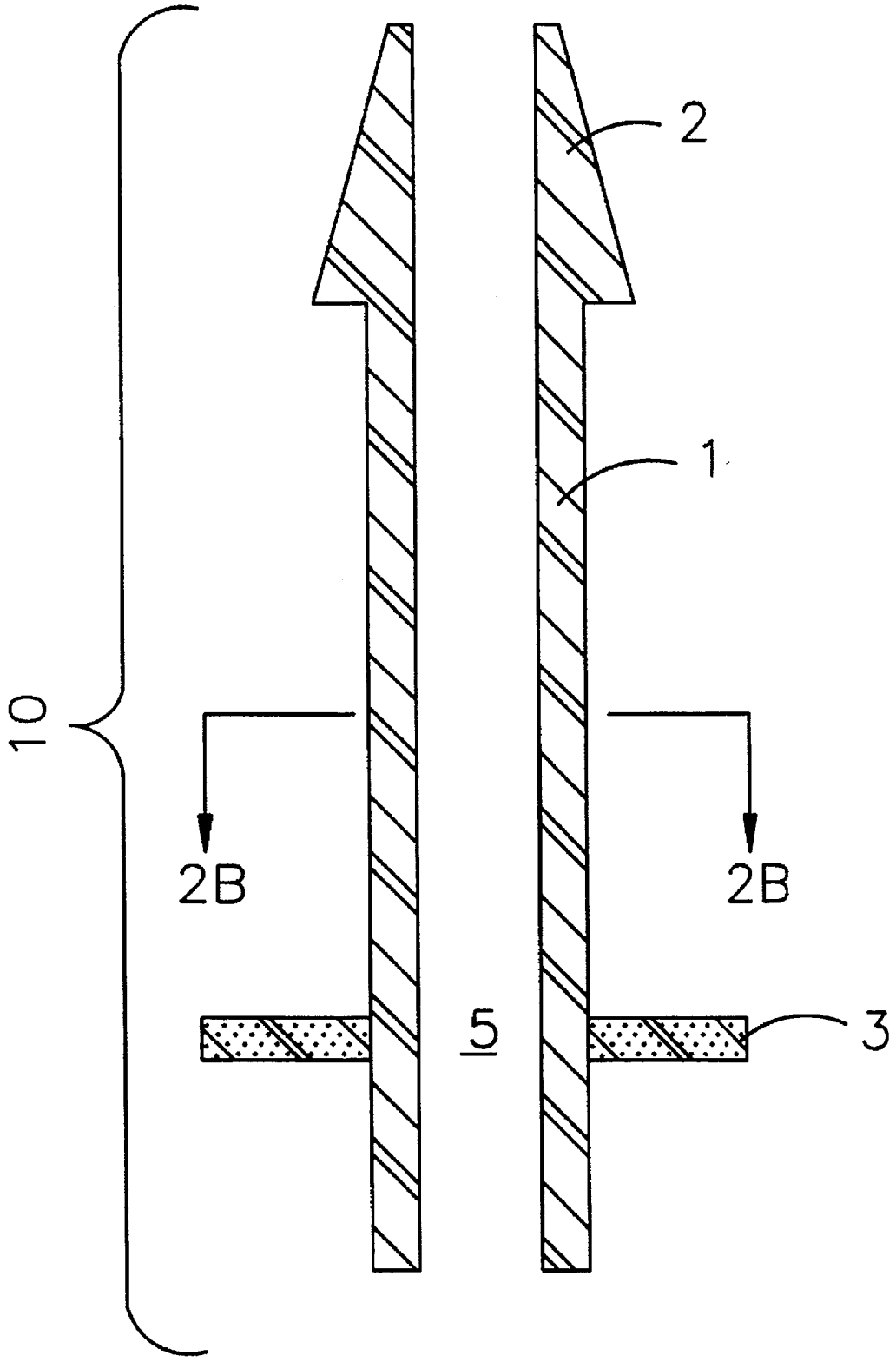
FIG. 1B is a cross-sectional view of the another embodiment of the instant invention, showing the conical top (upper taper cone) which matches the inside top diameter of a cone spool and showing the foam rubber, circular, bottom lip which deforms to match the inside bottom diameter of the cone spool.
Figure 2A:
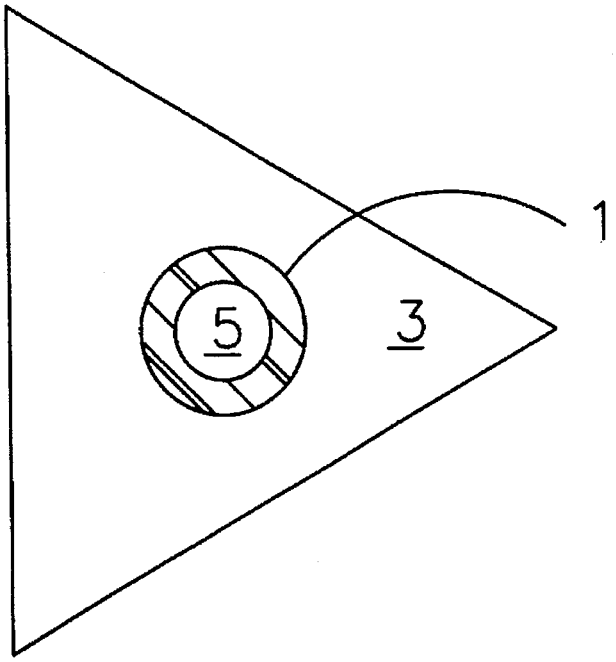
FIG. 2A is a sectional view taken at 2A—2A in FIG. 1A to clearly illustrate the preferred bottom lip in the first embodiment of the instant invention.
Figure 2B:
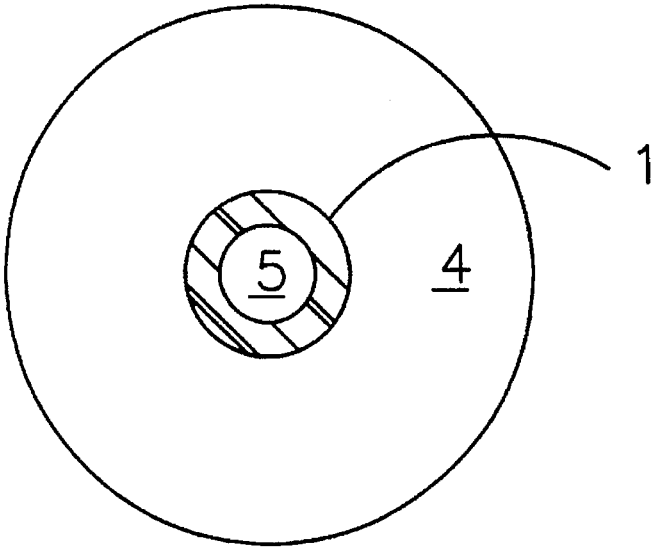
FIG. 2B a sectional view taken at 2B—2B in FIG. 1B to illustrate an alternative bottom lip in the first embodiment of file instant invention.
Figure 3:
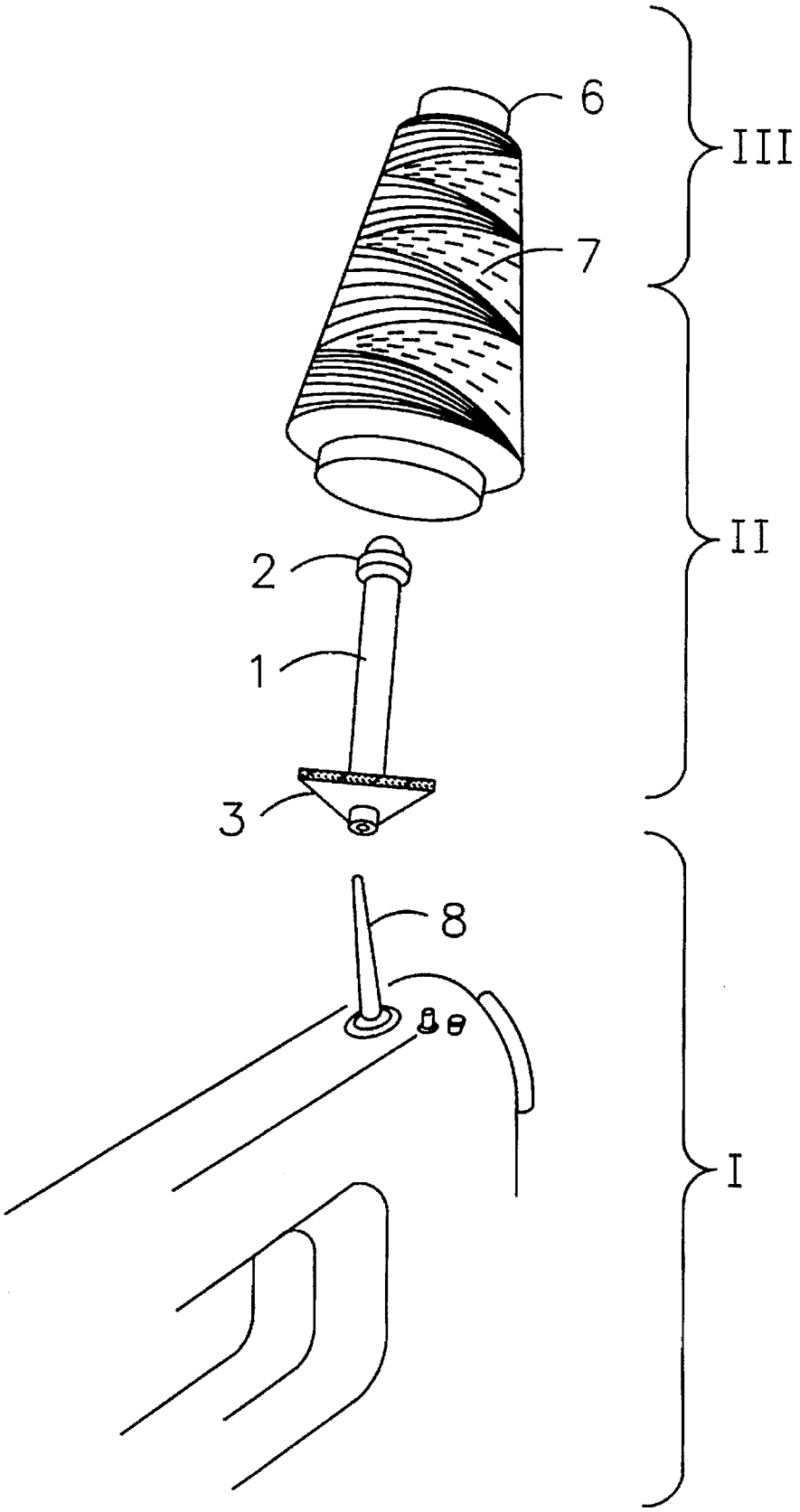
FIG. 3 shows how the preferred first embodiment is used on the sewing machine and how the cone spool fits on the instant invention.

The preferred embodiment will be described with respect to the first preferred embodiment of the instant invention, general item 10, which is illustrated in FIGS. 1 through 3. Referring to FIG. 1, the Sewing Machine Cone Spool to Spindle Adapter of the instant invention consists of a support conduit, 1, adapted to readily slide over the spool spindle, 8, of a sewing machine. The inner diameter, 5, is slightly larger than one-quarter inch (about 6.1 mm) which readily slides over the outside of a standard U.S. sewing machine spindle. The upper taper cone, 2, has a lower diameter of roughly three-quarters inch and tapers to roughly three-eights inch at the top. This particular part can easily be cut from ⅜-inch plastic lavatory supply tubing having a ferrule fitting molded at one end. The molded ferrule fitting serves as the upper taper cone. The preferred overall length is about 5 inches; however, longer conduits will be required for longer (specialty) cone spools.

The bottom lip, 3, is formed from plastic foam—similar to the type of foam used in air filters. The preferred embodiment of the bottom lip, see FIG. 2A, takes the shape of a triangle with an under-sized ⅜ inch centered aperture. The support conduit is inserted through the aperture in the triangular bottom lip and the lip is placed approximately one-inch from the bottom extremity of the support conduit.

An alternate form of the bottom lip is illustrated in FIG. 2B as item 4. This circular bottom lip can be made of foam or even formed as part of the molding process when the inner or support conduit is formed. The only restraint oil the bottom lip is that it should deform to snugly fit within the cone spindle.

The first embodiment is designed to support a cone spool at the top, that is the spool slides downward until its conical shape will no longer move past the upper cone of the support conduit. The bottom, or lower, lip provides stability to the cone spool in that the cone spool cannot readily wobble about its lower point due to the deformed foam. (Actually, when winding a bobbin, the cone spool still wobbles slightly due to its high angular velocity of rotation; however, the foam acts to reduce the wobble.) The bottom lip also provides a frictional restraint between the adapter and the cone spool so that both units revolve about the spindle. The support conduit and cone spool are free to rotate about the sewing machine spindle as thread is drawn from the cone spool.

FIG. 3 shows how the preferred first embodiment, 10, of the instant invention is placed over the sewing machine spindle, 8, with the cone spool, 6, containing thread, 7, placed over and on the instant invention.

Figure 4:
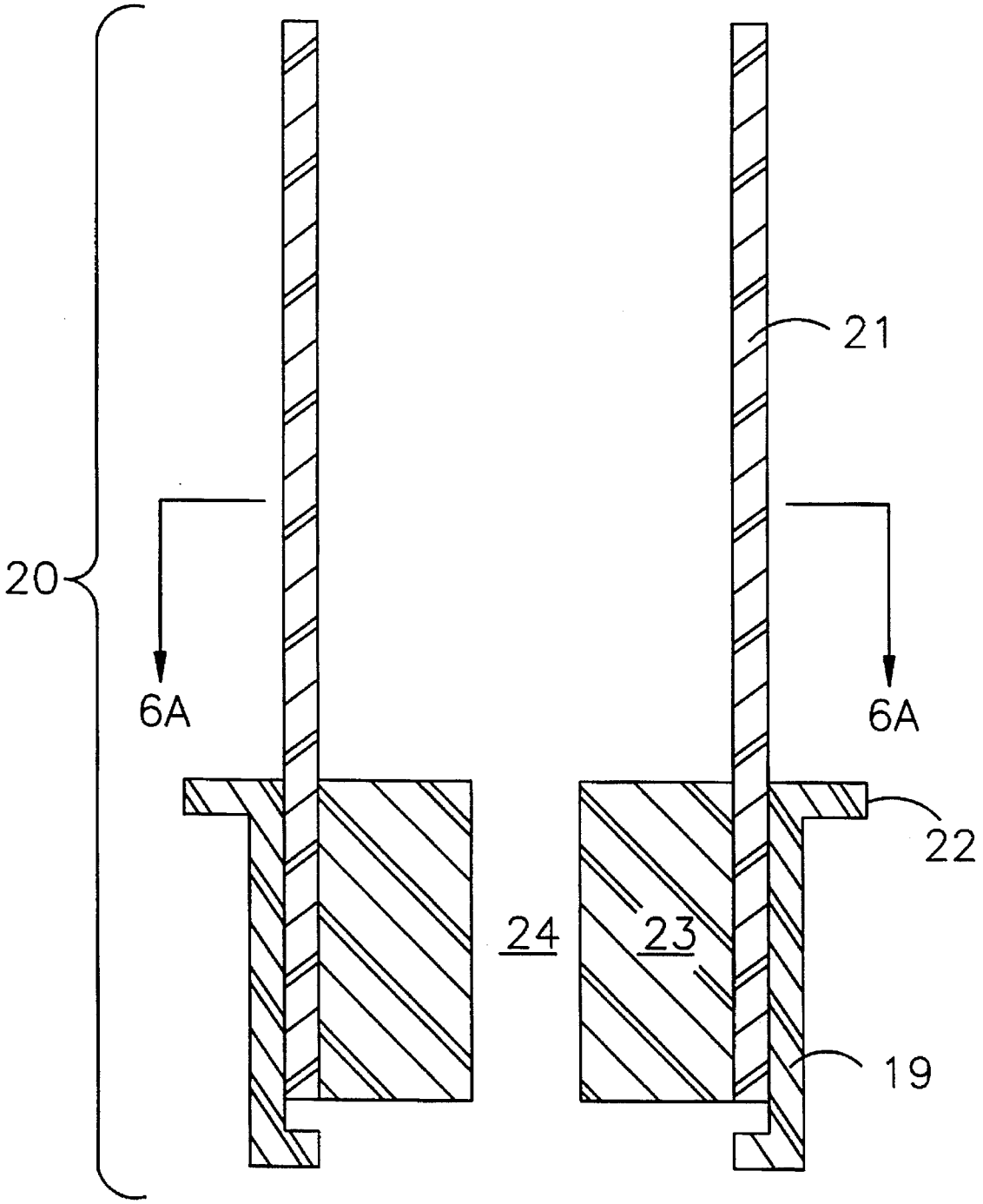
FIG. 4 is a cross-sectional view of the second embodiment, used for larger cone and flare bottom cones, of the instant invention, showing the preferred slip-fit inner spindle clamp.
Figure 5:
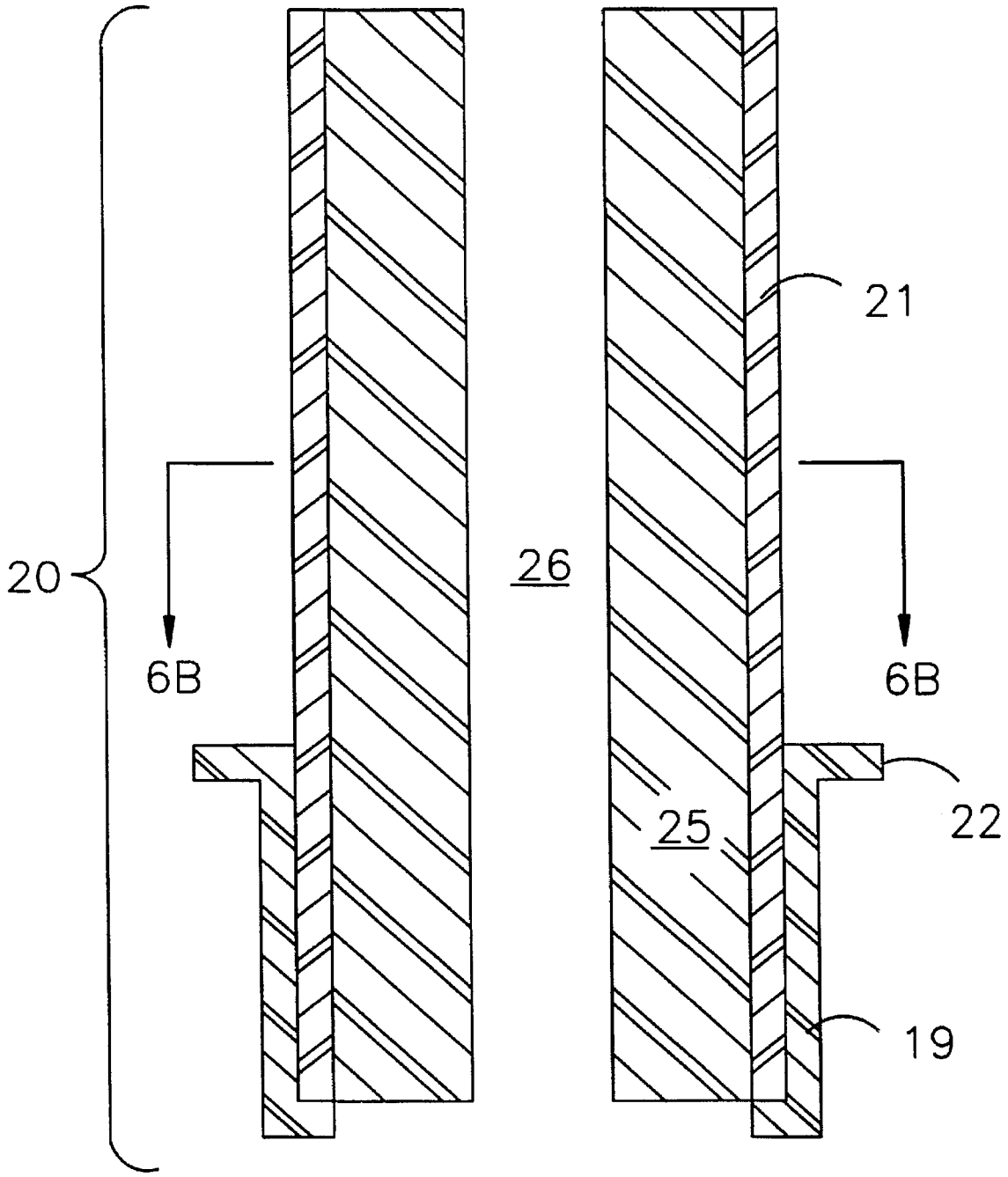
FIG. 5 is a cross-sectional view of an alternative to the second embodiment of the instant invention, showing a slide-fit inner spindle mount.
Figure 6A:
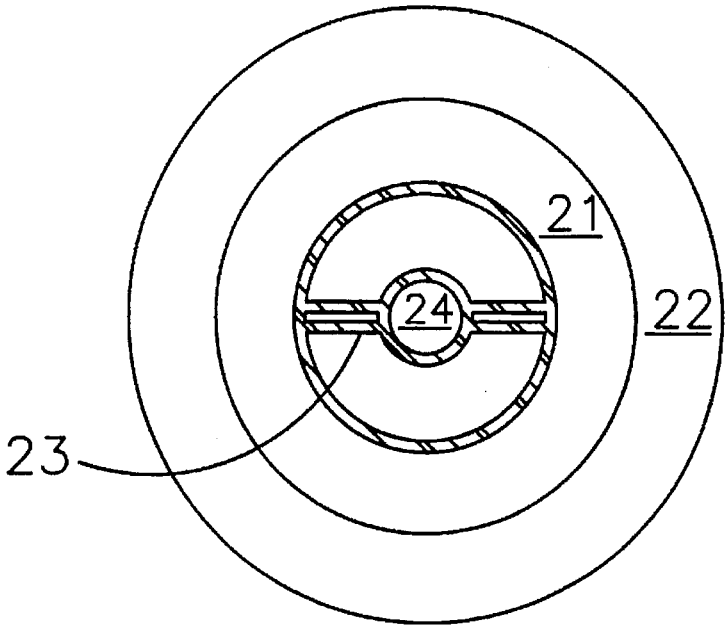
FIG. 6A is a sectional view taken at 6A—6A in FIG. 4 to clearly illustrate the preferred slip-fit inner spindle clamp in the second embodiment of the instant invention.
Figure 6B:
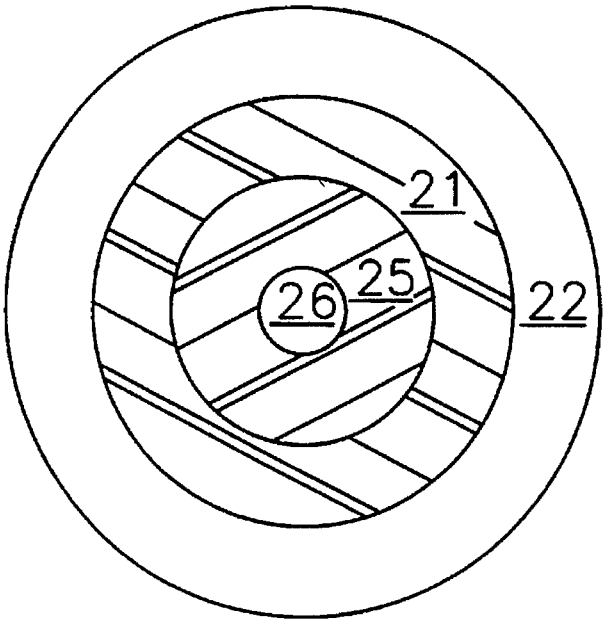
FIG. 6B is a sectional view taken at 6B—6B in FIG. 5 to illustrate an alternative to the slip-fit inner spindle clamp in the second embodiment of the instant invention.
Figure 7B:
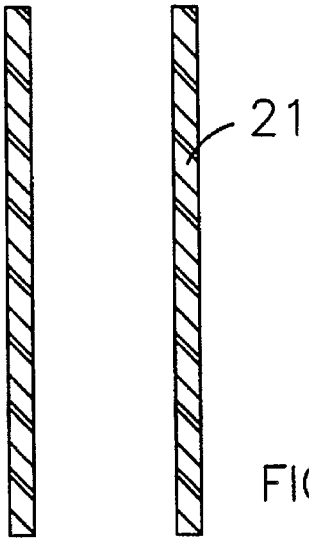
FIGS. 7B through 7D show the assembly steps of the alternate form of the second embodiment utilizing a spindle bearing surface.
Figure 7C:
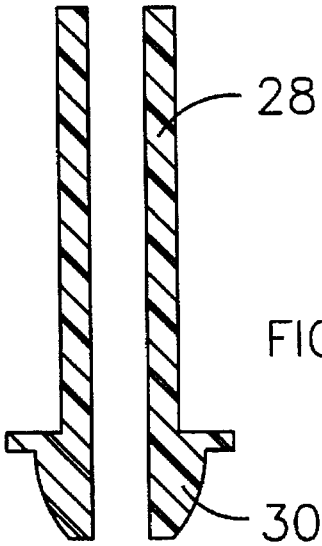
Figure 7A:
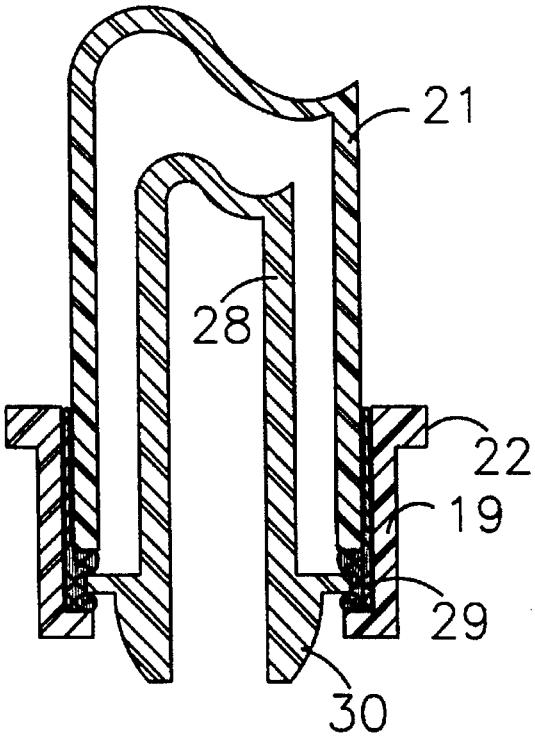
FIG. 7A shows an alternate form of the second embodiment illustrating how a spindle bearing surface may be manufactured from plastic lavatory supply tubing and placed within the adapter utilizing common off-the-shelf components.
Figure 7D:
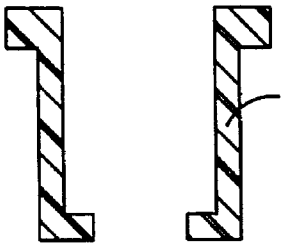

The second embodiment, shown in FIGS. 4 and 5, is similar to the first embodiment except that it is designed for large cone spools and the adapter does not necessarily have to freely rotate about the spindle. In fact, the one form of second embodiment uses a fixed spindle and the larger variety of cone spools revolve about the second embodiment as thread is drawn from the spool. Some European manufacturers of sewing machines use a European (Din) standard spindle which is several millimeters less than the U.S. standard. In this case this form of second embodiment will freely rotate about the spindle. Whether the adapter rotates, or whether the cone spool rotates, or whether both spool and adapter rotate together is not critical for the larger variety of cone spools.

Figure 8:
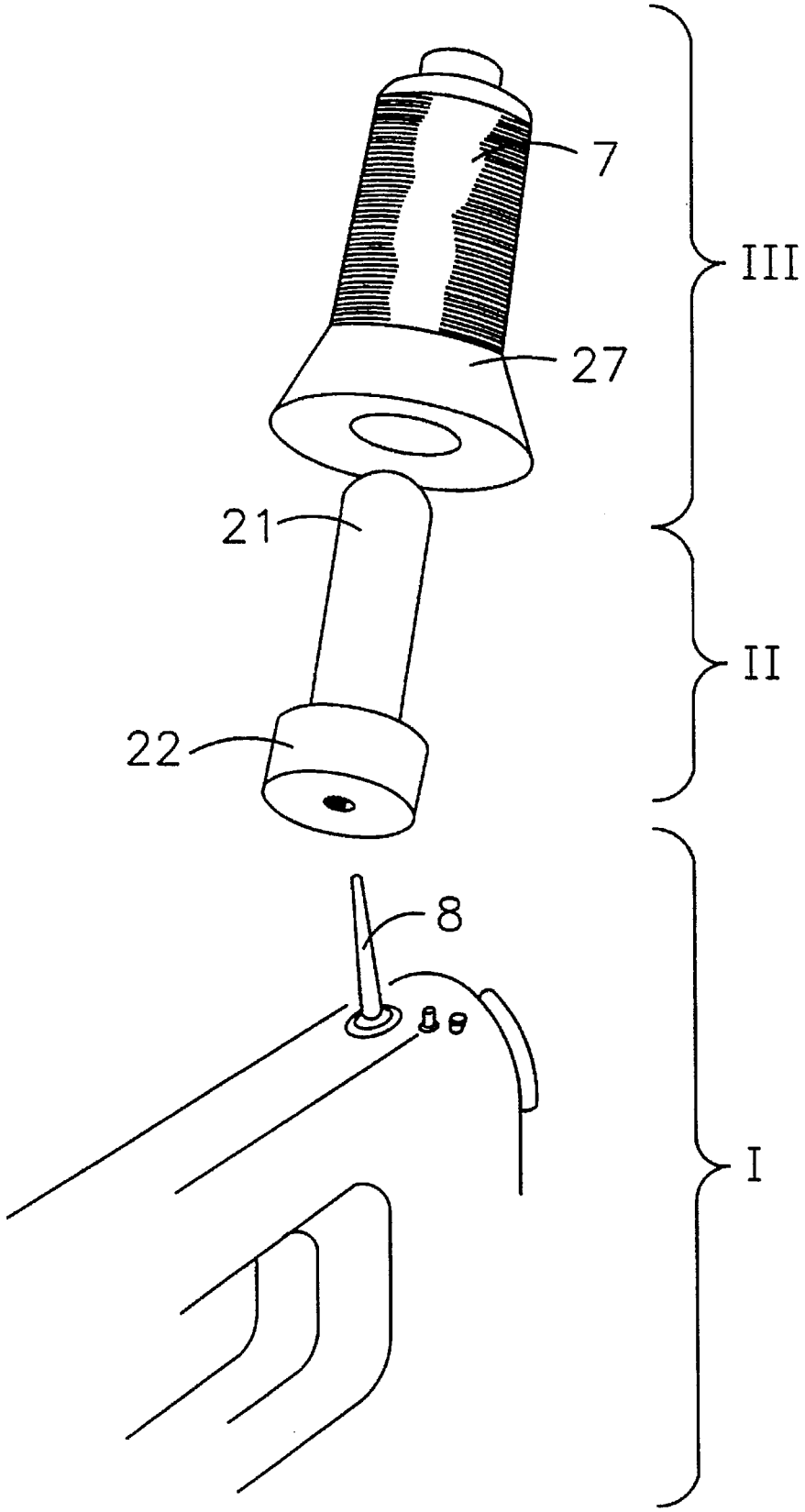
FIG. 8 shows how the second embodiment is used on the sewing machine and how the cone spool fits on the instant invention.

The support conduit, 21, of the second embodiment is manufactured from ½-inch plastic pipe and is about 4.5 inches long. The bottom lip, 22, is manufactured from a ½-inch to ¾-inch plastic swage, 19 (or reducing bushing). The best mode would be to form the support conduit, 21, and bottom lip, 22, in a single molding operation. In the first alternate to the second embodiment a spindle slip-clamp, 23, is inserted inside the support conduit, 21, and occupies the bottom ½-inch to ¾-inch of the support conduit. The spindle slip-clamp, 23, is a commercially available device which is designed to slide about a spindle and hold serger cone in a serger. The commercial device must be modified, by slicing off the wings, to fit within the conduit and has all aperture, 24, which is slightly less than the diameter of the spindle; however, the aperture is capable of springing apart and sliding over the sewing machine spindle, 8, as illustrated in FIG. 8.

A second alternate to the slip-clamp is shown in FIG. 5. Here the inside of the support conduit is filled with foam, 25, having an aperture, 26, extending through the foam which is slightly smaller than the diameter of the sewing machine spindle, 8.

The preferred alternate to the second embodiment is shown in FIGS. 7A through 7D which clearly illustrate a bearing surface. Here a standard ⅜-inch plastic lavatory supply tube, 28, having a ferrule end, 30, acts as the spindle bearing surface. In this alternate form of the second embodiment the ferrule, 30, is placed within the ½ by ¾ inch swage (or reducing bushing), 22, during assembly. Standard cement, 29, is also added to the inside of the swage, the outside of the ferrule, 30, and the outside of the support conduit, 21. All the items are pressed together and the glue holds all three together. This preferred alternate to the second embodiment now acts in the same manner as the first embodiment when placed on a sewing machine spindle. (That is, it is free to rotate.)

In fact, many different alternates for the second embodiment may be used and any person skilled in the art of manufacture and material could readily design all alternate slide-clamp, slip-clamp or bearing surface for the support conduit. For example, the support conduit can be molded to have an outside diameter equal to that of a ½-inch pipe, but have an inside diameter of about ¼-inch. These variants and similar variants for keeping the adapter on the sewing machine spindle are considered to be within the scope of the invention.

The second embodiment is designed to support a cone spool at the top, that is the spool slides downward until its conical shape will no longer move past the top of the support conduit but rides on the upper outer edge of the support tube. The bottom, or lower, lip provides stability to the cone spool in that, although the cone spool is allowed to wobble about its lower point, the amount of movement is limited. The cone spool, 27, is free to rotate about the preferred support conduit as thread, 7, is drawn from the cone spool. As previously stated, it should be noted that the second embodiment Call be designed so that the adapter rotates like the first embodiment with the cone spool fictionally held to the adapter. In fact, it would be possible to use a deforming plastic or foam bottom lip similar to the bottom lip of the first embodiment.

FIG. 8 shows how the second embodiment, 20, of the instant invention is placed over the sewing machine spindle, 8, with the cone spool, 27, containing thread, 7, placed over and on the instant invention.

It should be noted that a key idea in the instant device revolves about providing stability to the cone spool. If the bottom end of the cone spool was too free to wobble with respect to the vertical spindle axis, as thread was being drawn from the spool, the thread would become entangled. Thus the bottom lip must be chosen to restrict wobble. In the case of the smaller cone spools, for which the first embodiment is envisioned, wobble must be strictly controlled, and the deforming foam lip (or similar contrivance) stops all wobble. In the case of larger cone spools, the increased diameter of the spool itself makes the wobble less of a factor. Ill the second embodiment the amount of wobble is limited by the bottom lip.

There has been disclosed heretofore in the above discussion the best embodiments and best modes of the instant invention presently contemplated. It is to be understood that dimensions may be changed to fit larger or smaller spindles or conical spools. Different techniques of molding plastic parts may require slight changes in the physical form of the instant invention and such modifications call be made without departing from the spirit of the instant invention.

I claim:

1. A Sewing Machine Cone Spool to Spindle Adapter comprising:

a support conduit having a top end and a bottom end, a bottom lip secured to said support conduit near said bottom end thereof, and a spindle bearing surface being the inside surface of a ⅜-inch lavatory supply tube coaxially secured within said support conduit and extending from said bottom end of said support conduit towards said top end of said support conduit wherein said lavatory supply tube has a top end and a bottom end and having a molded ferrule at said bottom end thereof, wherein said molded ferrule is glued within said support conduit such that said lavatory supply tube, containing said spindle bearing surface, is coaxially received within said support conduit.

2. The adapter device of claim 1 wherein said bottom lip is the outside edge of a standard plastic ½-inch by ¾-inch reducing bushing and wherein said molded ferrule is glued within said support conduit such that said lavatory supply tube is coaxially received within said support conduit and wherein said ½-inch by ¾-inch reducing bushing is glued to said support conduit.

* * * * *